US007963197B2

(12) United States Patent
Starko

(10) Patent No.: US 7,963,197 B2
(45) Date of Patent: Jun. 21, 2011

(54) PLUMBING TOOL

(76) Inventor: Steven Starko, Grande Prairie (CA)

( * ) Notice: Subject to any disclaimer, the term of this patent is extended or adjusted under 35 U.S.C. 154(b) by 189 days.

(21) Appl. No.: 12/325,076

(22) Filed: Nov. 28, 2008

(65) Prior Publication Data

US 2010/0132516 A1 Jun. 3, 2010

(51) Int. Cl.
*B25B 13/48* (2006.01)
*B25B 23/16* (2006.01)

(52) U.S. Cl. ..... 81/176.15; 81/177.2

(58) Field of Classification Search ..... 81/176.15, 81/124.2, 177.2, 177.6–177.8
See application file for complete search history.

(56) References Cited

U.S. PATENT DOCUMENTS

| | | | | |
|---|---|---|---|---|
| 1,431,389 | A * | 10/1922 | Frisz | 81/177.7 |
| 2,522,038 | A | 12/1950 | Houghton | |
| 2,668,466 | A | 2/1954 | Schofield | |
| 2,956,461 | A | 10/1960 | Anderson | |
| 3,468,198 | A | 9/1969 | De Maio | |
| 3,675,516 | A | 7/1972 | Knudsen et al. | |
| D311,315 | S | 10/1990 | Duke | |
| 5,083,758 | A | 1/1992 | Duke | |
| 5,699,701 | A * | 12/1997 | Cotten, Jr. | 81/3.4 |
| 5,946,990 | A | 9/1999 | Bonacci | |
| 6,044,502 | A | 4/2000 | Fountain | |
| 6,044,732 | A | 4/2000 | Astle | |
| 6,058,813 | A | 5/2000 | Bryant et al. | |
| 6,212,709 | B1 | 4/2001 | Newton | |
| D480,933 | S | 10/2003 | Wendt | |
| 6,698,317 | B1 | 3/2004 | Machovsky | |
| 6,978,528 | B1 | 12/2005 | Stallings | |
| 7,013,764 | B2 | 3/2006 | Leatherby | |
| 2004/0255727 | A1 | 12/2004 | Kovach | |
| 2006/0207393 | A1 | 9/2006 | Stupar | |
| 2007/0028726 | A1 | 2/2007 | Kunkel et al. | |
| 2007/0157772 | A1 | 7/2007 | Parker | |
| 2007/0256237 | A1 | 11/2007 | Mayer | |
| 2009/0241740 | A1 * | 10/2009 | Heagerty | 81/63.1 |

* cited by examiner

*Primary Examiner* — David B Thomas
(74) *Attorney, Agent, or Firm* — Oyen Wiggs Green & Mutala LLP

(57) ABSTRACT

A plumbing tool permits a drain body to be held in a drain opening of a bathtub from behind a drain end of the bathtub. The plumbing too has a head that can be engaged to the drain body and a handle that can be positioned so that an end of the handle projects through an overflow opening of the bathtub. The tool can prevent rotation and lifting of the drain body.

16 Claims, 6 Drawing Sheets

PLUMBING TOOL

TECHNICAL FIELD

The invention relates to plumbing. Embodiments of the invention provide tools for holding drain bodies during installation.

BACKGROUND

Bathtub drains typically include a drain body that attaches under the bathtub to a drain line. The drain body is sometimes called a 'shoe plug' or 'drain basket'. The drain body extends through a drain opening in the bottom of the bathtub. A sealant, such as a suitable gasket, a curable sealant—for example a suitable silicone sealant, or a non-curing sealant, such as plumber's putty or the like is provided between a flange projecting from the drain body and the inside of the bathtub. The drain body typically has male threads which thread into female threads of a waste shoe located under the bathtub.

A person installing a bathtub drain may need to hold the drain body in place from inside the bathtub while working under the bathtub to fasten the drain body to a drain shoe or other plumbing. This can be awkward but is especially difficult where the bathtub has an integral enclosure. In some cases access to the underside of a bathtub is only available from a nearby room from which a person cannot reach the inside of the bathtub to hold the drain body in place.

There are a range of tools available for installing and removing drain bodies. These include strainer basket wrenches, dumbbell tub drain wrenches, internal tub drain wrenches. Some tools are described in the following US patents and patent applications:

2007/0028726 (Kunkel et al.)
U.S. Pat. No. 6,698,317 (Machovsky)
U.S. Pat. No. 6,044,732 (Astle)
U.S. Pat. No. 2,956,460 (Anderson)
D480,933 (Wendt)
U.S. Pat. No. 5,083,758 (Duke)
2004/0255727 (Kovach)
U.S. Pat. No. 6,044,502 (Fountain)
U.S. Pat. No. 6,978,528 (Stallings)
U.S. Pat. No. 3,468,198 (De Maio)
U.S. Pat. No. 2,668,466 (Schofield)
U.S. Pat. No. 6,058,813 (Bryant et al.)
U.S. Pat. No. 6,212,709 (Newton)
U.S. Pat. No. 2,522,038 (Houghton)
2006/0207393 (Stupar)
2007/0157772 (Parker)
2007/0256237 (Mayer)
U.S. Pat. No. 5,946,990 (Bonacci)
U.S. Pat. No. 7,013,764 (Leatherby)
U.S. Pat. No. 3,675,516 (Knudsen et al.)
D311,315 (Duke)

These tools do not address the above-noted problem.

There is a need for tools and methods which facilitate the efficient installation of tub drains, especially for tubs that include integral enclosures.

SUMMARY OF THE INVENTION

This invention has a number of aspects. Some aspects of the invention provides a tool for holding drain bodies during installation. Some aspects of the invention provides methods for installing drain bodies.

One aspect of the invention provides a plumbing tool comprising a head configured to engage a drain body and a handle coupled to the head. The handle is configured to project through an overflow opening of a bathtub with the head engaged with a drain body in a drain opening of the bathtub. In some embodiments the handle comprises a first part pivotally coupled to the head and a second part pivotally coupled to the second part. A point of coupling of the first part to the second part may be adjustable along the second part.

Another aspect of the invention provides a method for holding a drain body in a drain opening of a bathtub. The method may be performed for installation of the drain body. The method comprises engaging a head of a tool with the drain body and placing a handle connected to the head so that a portion of the handle extends through an overflow opening of the bathtub. The method continues by holding the extending portion of the handle while connecting the drain body to plumbing under the bathtub. The plumbing may, for example, comprise a drain shoe.

Further aspects of the invention and features of specific embodiments of the invention are described below.

BRIEF DESCRIPTION OF THE DRAWINGS

The accompanying drawings illustrate non-limiting embodiments of the invention.

List of References

| | | | |
|---|---|---|---|
| 10 | tool | 12 | handle |
| 14 | head | 15 | nose |
| 16 | projection | 16A | channel |
| 17 | thickened portion | 18 | first part of handle |
| 18A | first end of first part | 18B | second end of first part |
| 19 | coupling | 19A | ear |
| 19B | pin | 19C | pivot axis |
| 20 | second part of handle | 20A | first end of second part |
| 20B | second end of second part | 21 | coupling |
| 21A | arm | 22 | pivot axis |
| 23 | holes | 24 | pin |
| 25 | clip | 30 | bathtub |
| 32 | tub surround | 34 | drain opening |
| 36 | overflow opening | 38 | drain shoe |
| 39 | portion of drain body | 39A | threads |
| 40 | drain body | 42 | flange |
| 43 | bore | 44 | threads |
| 46 | spider | 47 | axis of head |
| 48 | range of pivotal motion | 48A | range of pivotal motion |
| H | horizontal distance | V | vertical distance |

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
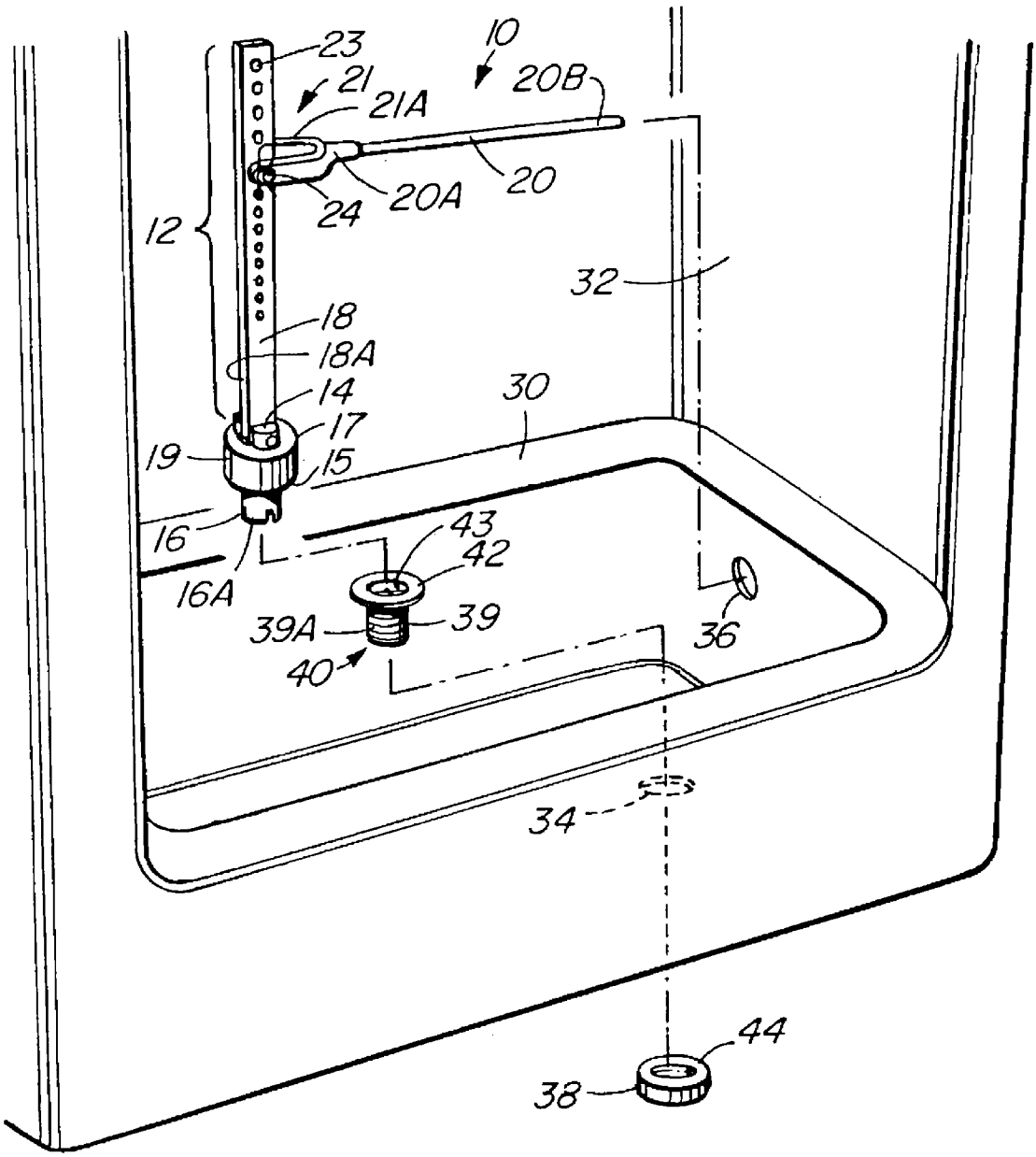
FIG. 1 shows a tool according to an example embodiment of the invention.

FIG. 1 illustrates a tool 10 according to an example embodiment of the invention. Tool 10 has a handle 12 connected to a head 14. Head 14 is configured to engage a drain body 40. In the illustrated embodiment, head 14 has a nose 15 that is dimensioned to extend into the bore 43 of drain body 40 and projections 16 on nose 15 that engage a spider 46 of drain body 40. In alternative embodiments, head 14 has interchangeable nose pieces configured to engage drain bodies of different kinds or an expandable nose capable of engaging the wall of bore 43.

Head 14 is advantageously weighted so that tool 10 can be held in place in a drain body 40 by its own weight. In an example embodiment, head 14 has a weight in the range of about 2 to 9 pounds (about ¾ to 4 kilograms). In another example embodiment, head 14 has a weight if 5 pounds±1 pound. In the illustrated embodiment, head 14 is made of steel and has a thickened portion 17. Thickened portion 17 increases the mass of head 14 and in some embodiments a lower side of thickened portion 17 may also bear against a drain body in a way that stabilizes tool 10 in use.

Handle 12 comprises first and second parts 18 and 20. In the illustrated embodiment, each of the first and second parts comprises an elongated member. First and second parts 18 and 20 may comprise, for example, straight metal rods or bars.

First part 18 is pivotally attached to head 14 at coupling 19. In the illustrated embodiment, coupling 19 comprises a pair of ears 19A and a pin 19B. Coupling 19 permits first part 18 to pivot relative to head 14 about a pivot axis 19C.

Figure 5:
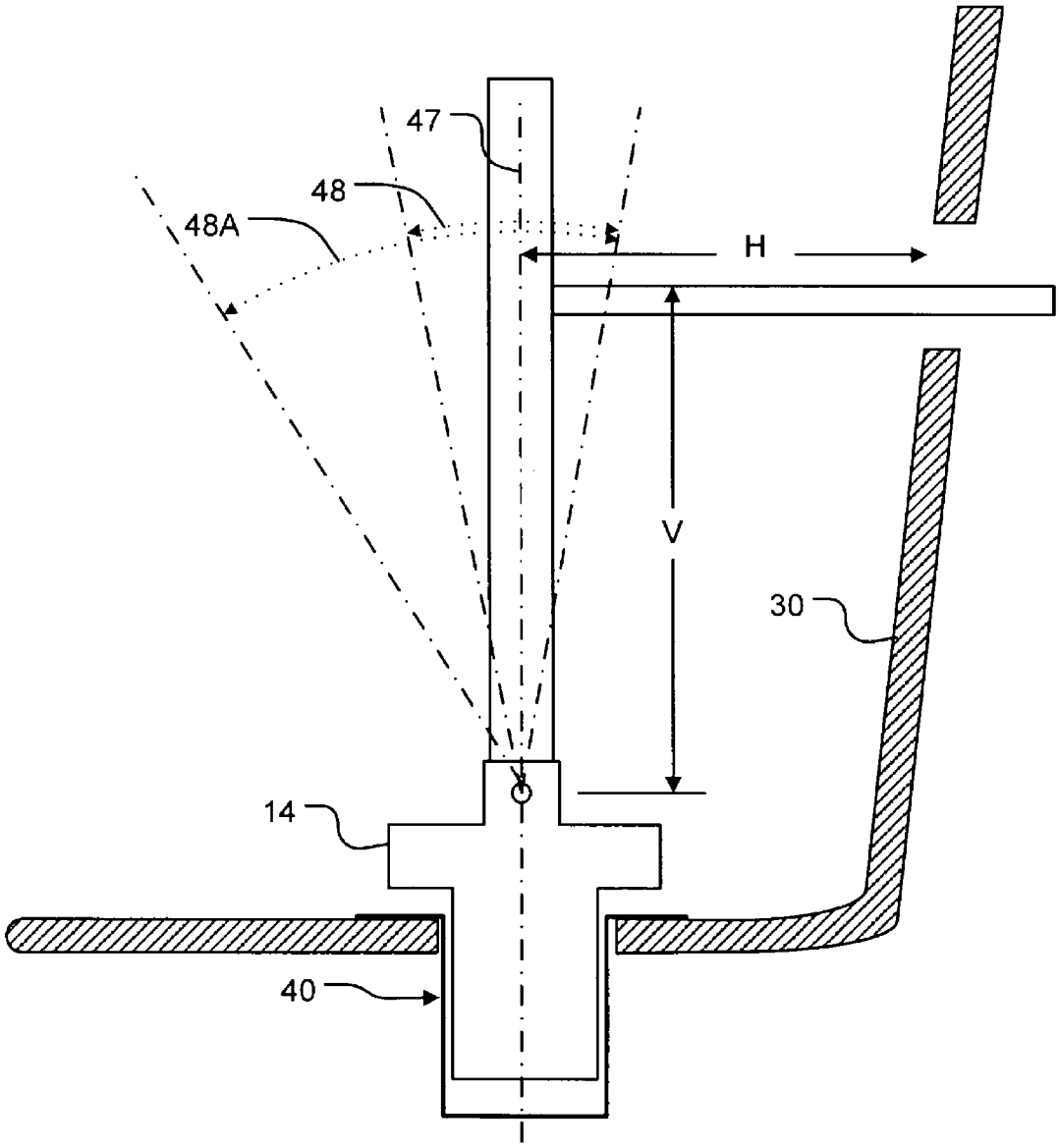
FIG. 5 is a sketch illustrating geometry of an example embodiment of the tool.

In some embodiments, first part 18 is capable of pivoting relative to head 14 only through a restricted range of motion. For example, as shown in FIG. 5, first part 18 may be roughly aligned with an axis 47 of head 14 and have a range of pivotal motion 48 of a few degrees (e.g. about 5 to 30 degrees) either way. In some embodiments, the range of pivotal motion of first part 18 is asymmetrical such that first part 18 can pivot farther from vertical in a direction away from the side on which second part 20 projects than it can pivot in the direction toward the side on which second part 20 projects. This is indicated by the range 48A shown in FIG. 5, for example. Range 48A is advantageous because first part 18 is on either side of vertical when it is at either one of the ends of range 48A. Thus, as long as head 14 is held upright, first part 18 can remain standing stably at either end of its range 48A.

In the embodiment illustrated in FIG. 1, a limitation in the range of pivotal motion of first portion 18 may be provided by allowing corners of first end 18A of first part 18 to hit head 14 at ends of the range of pivotal motion 48. In the alternative other range-limiting features may be provided such as stops located to hit first part 18 at the ends of the range of pivotal motion and the like.

In some alternative embodiments, coupling 19 provides sufficient resistance to pivoting motion of first part 18 (for example, by providing suitable indetents or frictional resistance to pivotal motion) that first part 18 tends to remain at an angle to which it is set but can be pivoted about axis 19C.

Second part 20 of handle 12 is pivotally coupled to first part 18 by a coupling 21 located toward a second end 18B of first part 18. Coupling 21 allows second part 20 to pivot relative to first part 18. A wide range of designs may be applied to coupling 21. In the illustrated embodiment, coupling 21 comprises arms 21A that extend on either side of first part 18 and a pin 24 that passes through apertures in arms 21A and an aperture 23 in first part 18. This permits second part 20 to pivot relative to first part 18 about an axis 22 that is generally parallel to axis 19C. In the illustrated embodiment, pivot axes 19C and 22 are both generally at right angles to axis 47 of head 14.

The location at which second part 20 is coupled to first part 18 is adjustable along first part 18. In the illustrated embodiment, this adjustability is achieved by providing multiple holes 23 at various locations along first part 18. Pin 24 can be withdrawn from one hole 23 after removing clip 25 and inserted through a different one of holes 23. The same result could be achieved by providing a coupling that can slide along first part 18 and be clamped to first part 18 at a desired location, for example.

In a prototype embodiment:

- first part 18 has a length of approximately 17 inches (about 43 cm) measured from pivot axis 19C,
- the distance between pivot axis 19C and the pivot axis defined by bn 24 is adjustable in a range of about 8½ inches (about 21 cm) to about 16 inches (about 41 cm),
- the distance from the tip of nose 16 to pivot axis 19C is about 2¾ inches (about 7 cm), and
- second part 20 has a length of approximately 12 inches (about 30 cm).

These dimensions are by way of example only.

FIG. 1 illustrates a use of tool 10. A bathtub 30 has a surround 32. Bathtub 30 has a drain opening 34 and an overflow opening 36. The relative locations of drain opening 34 and overflow opening 36 vary with the design of bathtub 30. In typical cases, drain opening 34 and overflow opening 36 are separated by a horizontal distance H (see FIG. 5) in the range of about 6 inches (about 15 cm) to about 10 inches (about 26 cm) and a vertical distance V in the range of about 10 inches (about 25 cm) to about 16 inches (about 41 cm).

A drain body 40 fits through drain opening 34 into a drain shoe (or other below-tub plumbing) 38. Drain body 40 is received in drain opening 34 and has a flange 42 that extends around drain opening 34 inside bathtub 30. A portion 39 of drain body 40 extends through drain opening 34 and connects to drain shoe 38. In the illustrated embodiment, portion 39 has external (male) threads 39A that engage internal (female) threads 44 in drain shoe 38. Drain body 40 has a bore 43.

In many cases, drain body 40 includes a spider 46 that extends across bore 43. Spider 46 may, for example, provide a guide or support for a stopper assembly, prevent larger objects from going through drain body 40 or the like. Spiders 46 are a feature of many commercially-available drain bodies. In the illustrated embodiment, spider 46 is generally X-shaped. In some embodiments a tool has elements that engage a spider of a drain body to prevent rotation of the drain body. The presence of a spider is not mandatory since a tool according to the invention could engage a drain body in other ways.

Figure 2:
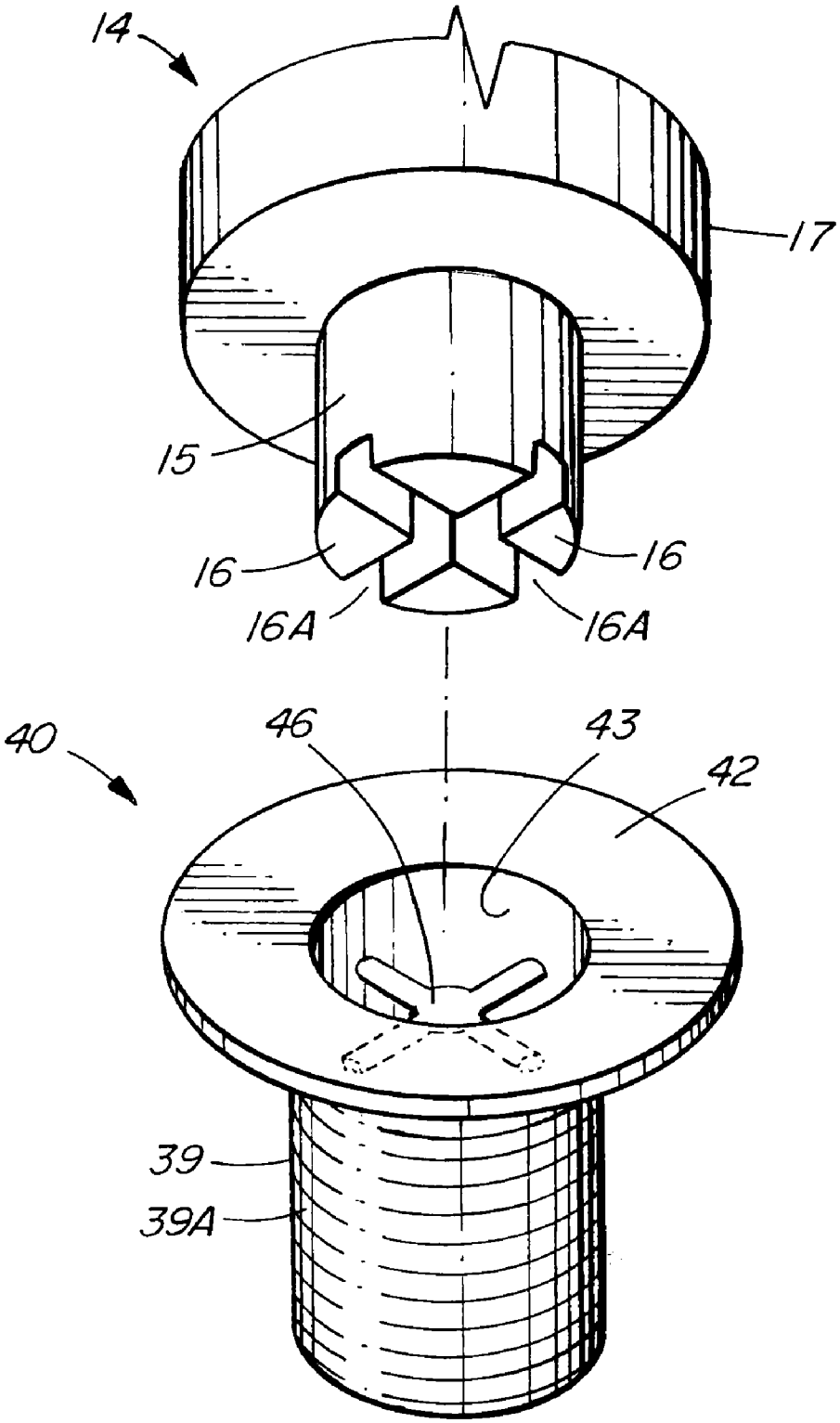
FIG. 2 is detailed view illustrating the engagement of a head of the tool of FIG. 1 with a drain body.
Figure 3:
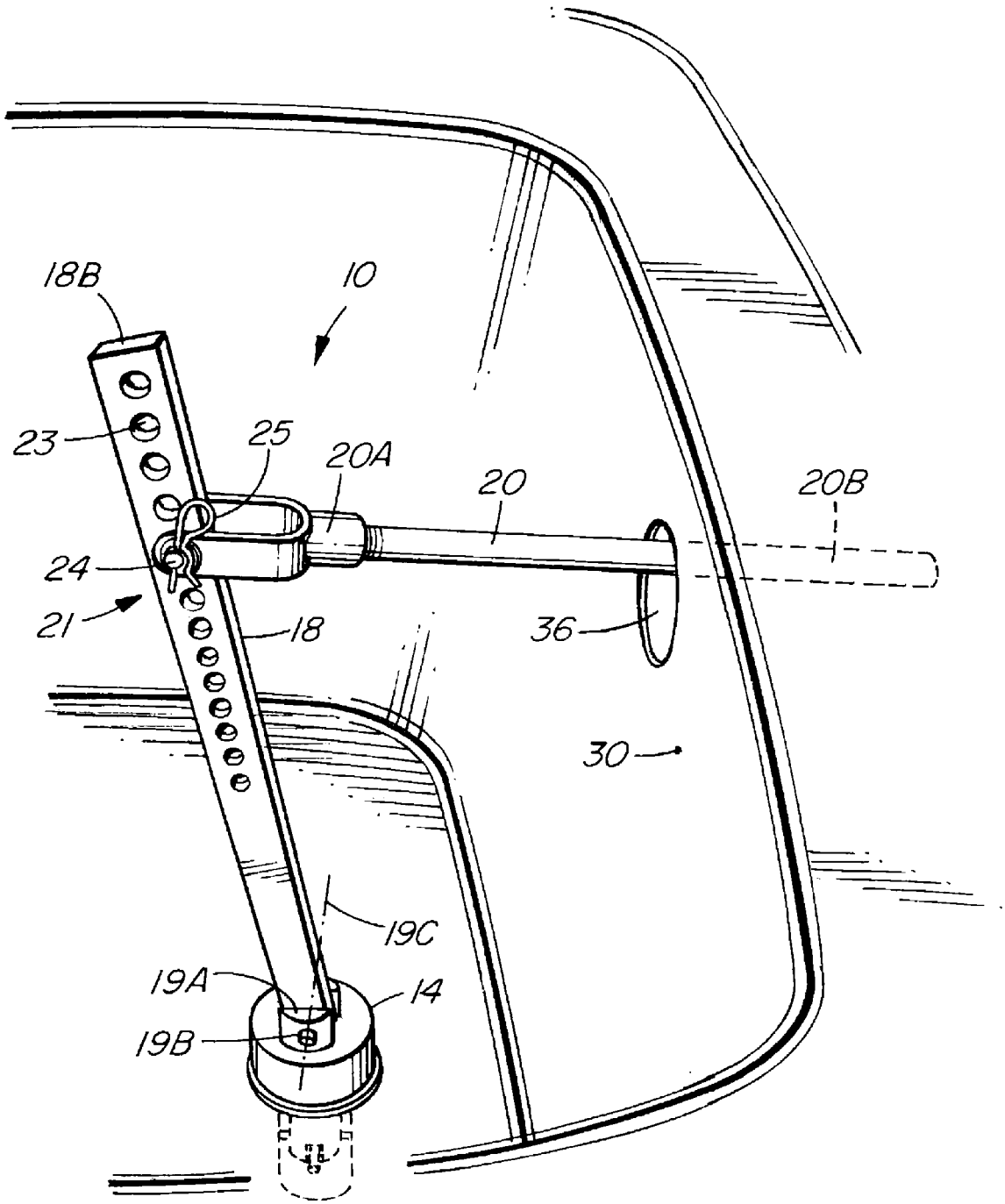
FIG. 3 is a view showing the deployment of the tool in a bathtub.

From FIGS. 1 and 3 it can be seen that the illustrated tool 10 can be used by placing drain body 40 in drain opening 34 and placing nose piece 15 of tool 10 into drain body 40 so that projections 16 engage a spider 46 of drain body 40 in channels 16A (see FIG. 2, spider 46 is not shown in FIG. 1). Second part 20 of handle 12 is coupled to first part 18 at a position such that second part 20 can be extended through overflow opening 36 of bathtub 30.

The length of second part 20 is sufficient to allow second part 20 to project through a drain opening far enough to be held by a user working on the far side of the drain opening. First part 18 can pivot sufficiently relative to head 14 to allow the free end 20B of second part 20 to be brought into general alignment with the overflow opening without scraping the end of the bathtub.

In the illustrated embodiment, the location at which second part 20 is coupled to first part 18 can be adjusted to suit overflow openings 36 at various elevations above drain openings 34. A tool intended for use only with a specific type of bathtub or for use with bathtubs having a given relative location of the drain and overflow openings would not need this adjustability.

Figure 4:
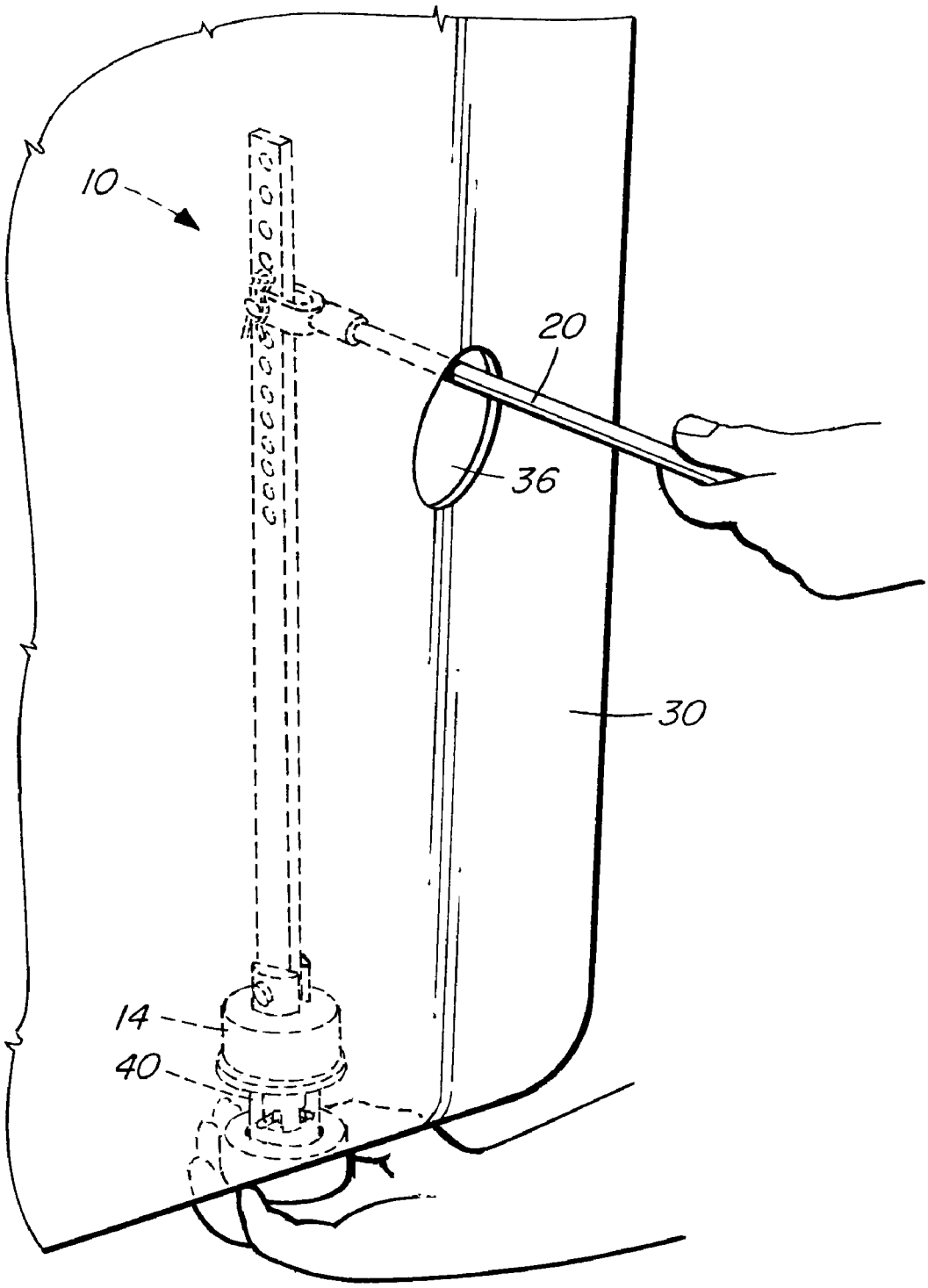
FIG. 4 is a view showing use of the tool to hold a drain body in place.

FIG. 4 shows a user located behind the drain end of bathtub 30 where the user can connect drain body 40 to a drain shoe 38 under bathtub 30. The user can hold the end 20B of tool 10 that projects through overflow opening 36. The user can thereby prevent drain body 40 from rotating and can also hold drain body 40 firmly in place in drain opening 34 while drain body 40 is coupled to plumbing under bathtub 30.

The user can adjust the connection of second part 20 to first part 18 so that second part 20 is at least roughly aligned with the overflow opening of the bathtub when head 14 of tool 10 is engaged with a drain body in the drain opening of the bathtub. The user can then set tool 10 in place and manipulate second part 20 so that its end projects through overflow opening 36. This can be done while the user is working from beside bathtub 30. If tool 10 is constructed such that the range of pivotal motion of first part 18 about axis 19C is limited or there is resistance to pivoting about axis 19C then this construction will help to keep tool 10 in place while a user moves to a location behind the drain end of bathtub 30.

Figure 6:
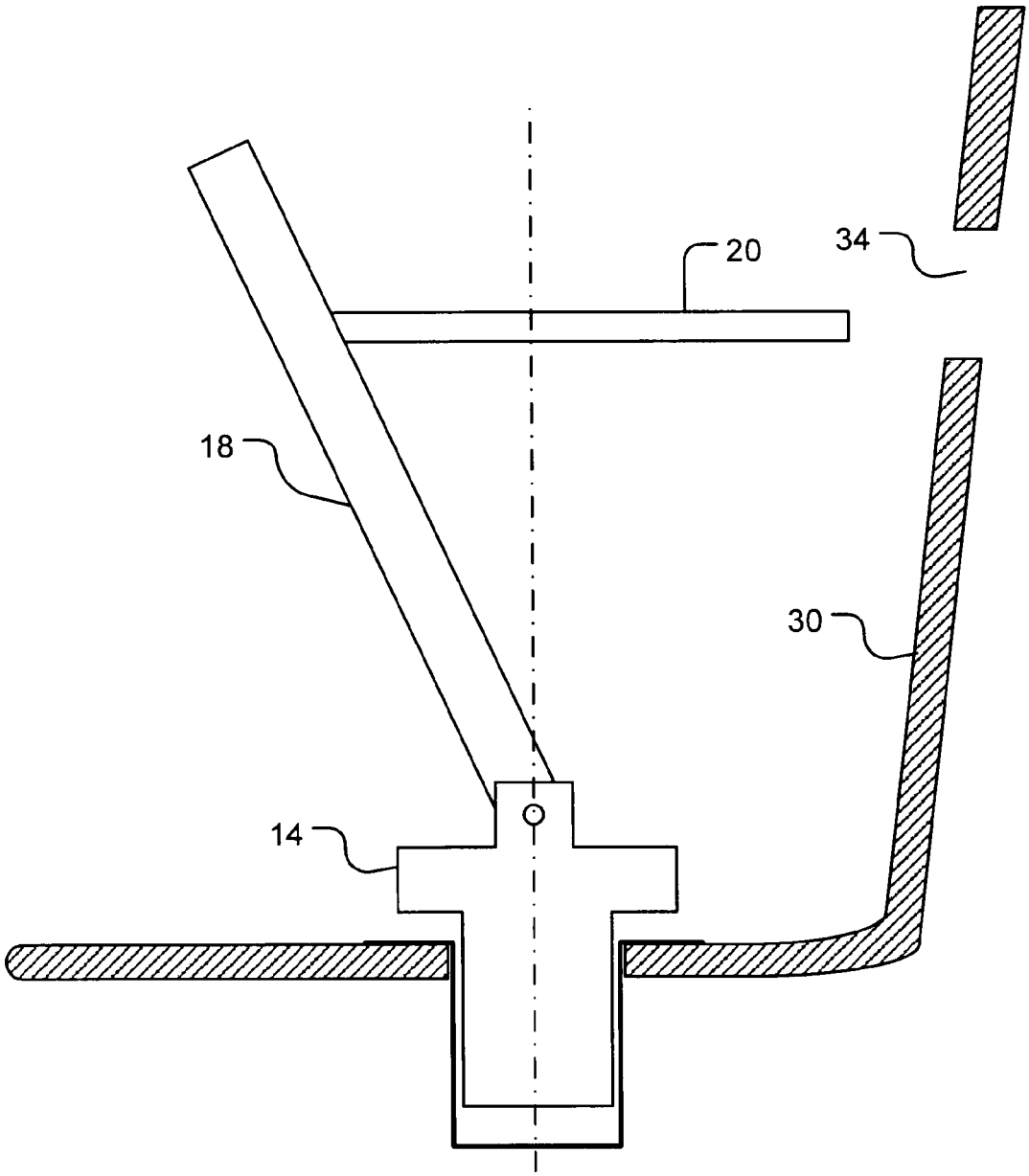
FIG. 6 is a sketch illustrating a tool according to an example embodiment that has been used to install a drain body.

After the user finishes securing the drain body 40 then second part 20 of handle 12 may be pushed back into bathtub 30 and out of overflow opening 34. Preferably, tool 10 remains standing after this has been done. This is shown in FIG. 6 in which the weight of head 14 and/or the engagement of head 14 in drain body 14 is sufficient to keep tool 10 upright. With second part 20 clear of drain opening 34 the user can arrange a drain fixture to connect with overflow opening 34 still working from the location behind the drain end of bathtub 30. The user can then return to beside bathtub 30 to remove tool 10 and to complete installation and tightening of the drain fixture.

One method of use of a tool like tool 10 comprises providing a tool having a head and a handle coupled to the head; engaging the head with a drain body in the drain opening of a tub; positioning the handle so that an end of the handle projects through an overflow opening of the bathtub; and then grasping the projecting end of the handle to hold the drain body in place while coupling the drain body to a drain shoe or other plumbing beneath the bathtub.

It can be understood that the tool 10 illustrated in the accompanying drawings is a specific embodiment of a general inventive concept which provides a tool having a head adapted to engage a drain body and a handle coupled to the head and configured so that the handle can be placed to project through an overflow opening of a bathtub with the head engaged with a drain body in a drain opening of the bathtub.

Where a component (e.g. a handle, coupling, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

As will be apparent to those skilled in the art in the light of the foregoing disclosure, many alterations and modifications are possible in the practice of this invention without departing from the spirit or scope thereof. For example:

- a tool according to the invention may engage a drain body 40 in a wide range of different ways such as, for example, by means of: rubber or other suitable material that frictionally engages flange 42 and/or bore 43 of drain body 40; projections, pins or the like that engage a spider of drain body 40; a mandrel or the like that can be expanded to grip the inside of bore 43; etc.
- Second part 20 of handle 12 could be adjustable in length. For example, second part 20 could be telescopic or could slide longitudinally relative to coupling 21. In some embodiments where the length of projection of second part 20 from first part 18 is adjustable, the range of pivotal motion of first part 18 relative to head 14 may be reduced, even to the point that first part 18 is rigidly affixed to head 14 in some embodiments.
- Various other handle designs can permit the handle to be placed to project through an overflow opening of a bathtub while the head is engaged with a drain body in a drain opening of the bathtub. For example, a handle may have several (e.g. two, three or more) sections that are pivotally coupled to one another and equipped with clamps or other locking means to hold them at set angles.
- It is desirable but not mandatory that second part 20 is short enough to be inserted through a drain opening of a bathtub while head 14 is engaged with a drain body in a drain opening of the bathtub. Where second part 20 is longer, second part 20 could be inserted first through the overflow opening and then head 14 could be engaged to the drain body.
- A tool as described herein may be used to tighten drain bodies without projecting the tool though an overflow opening.

Accordingly, the scope of the invention is to be construed in accordance with the substance defined by the following claims.

What is claimed is:

1. A plumbing tool comprising:

a head configured to engage a drain body; and, a handle coupled to the head, the handle configured to project through an overflow opening of a bathtub with the head engaged with a drain body in a drain opening of the bathtub wherein the handle comprises a first part pivotally coupled to the head and a second part pivotally coupled to the second part and a point of coupling of the first part to the second part is adjustable along the first part.

2. A plumbing tool according to claim 1 wherein a pivotal range of motion of the first part relative to the head is limited to an angular range not exceeding 60 degrees by interference between the first part and surfaces on the head.

3. A plumbing tool according to claim 1 wherein the first part is pivotal relative to the head about a first pivot axis and the second part is pivotal relative to the first part about a second pivot axis and the first and second pivot axes are generally parallel.

4. A plumbing tool according to claim 3 wherein the first and second pivot axes are generally at right angles to a longitudinal axis of the head.

5. A plumbing tool according to claim 3 wherein a pivotal range of motion of the first part relative to the head is limited to an angular range and the angular range is asymmetrical relative to a longitudinal centerline of the head.

6. A plumbing tool according to claim 5 wherein the pivotal range of motion is greater in a direction opposed to a direction in which the second part projects from the first part than it is in the direction in which the second part projects from the first part.

7. A plumbing tool according to claim 5 wherein, when the head is oriented with the longitudinal centerline of the head vertical, endpoints of the pivotal range of motion are on either side of vertical.

8. A plumbing tool according to claim 1 wherein the head has a weight of at least 2 pounds.

9. A plumbing tool according to claim 1 wherein the head comprises projections configured to engage a spider of a drain body.

10. A plumbing tool according to claim 9 wherein the projections define a pair of intersecting channels configured to receive a spider of a drain body.

11. A plumbing tool according to claim 10 wherein the channels intersect at right angles to receive an X-shaped spider of a drain body.

12. A plumbing tool according to claim 1 wherein the head comprises a nose having a diameter not exceeding 1½ inches extending from an expanded portion having a diameter greater than 1½ inches.

13. A plumbing tool comprising:

a head configured to engage a drain body; and, a handle coupled to the head, the handle configured to project through an overflow opening of a bathtub with the head engaged with a drain body in a drain opening of the bathtub wherein the handle comprises a first part pivotally coupled to the head and a second part pivotally coupled to the second part, a point of coupling of the first part to the second part is adjustable along the first part and the first part comprises a plurality of holes spaced apart along the first part and a coupling between the first and second parts comprises a pin that is insertable into one of the plurality of holes.

14. A method for holding a drain body in a drain opening of a bathtub, the method comprising:

engaging a head of a tool with the drain body and placing a handle connected to the head so that a portion of the handle extends through an overflow opening of the bathtub; and holding the extending portion of the handle while connecting the drain body to plumbing under the bathtub.

15. A method according to claim 14 wherein the head comprises one or more projections that project past a spider of the drain body and the method comprises holding the drain body against rotation.

16. A method according to claim 14 wherein the handle comprises a first part pivotally coupled to the head and a second part pivotally coupled to the first part and the method comprises adjusting a location along the first part at which the second part is coupled to the first part wherein placing the handle comprises inserting the second part of the handle to extend through the overflow opening.

* * * * *